US006658860B2

(12) United States Patent
McGrew

(10) Patent No.: US 6,658,860 B2
(45) **Date of Patent: *Dec. 9, 2003**

(54) COUNTER-FLOW HEAT PUMP

(76) Inventor: Stephen P. McGrew, 9715 W. Sunset Hwy., Spokane, WA (US) 99224

( * ) Notice: Subject to any disclaimer, the term of this patent is extended or adjusted under 35 U.S.C. 154(b) by 0 days.

This patent is subject to a terminal disclaimer.

(21) Appl. No.: 10/076,974

(22) Filed: Feb. 15, 2002

(65) Prior Publication Data

US 2003/0154725 A1 Aug. 21, 2003

(51) Int. Cl.[7] ..... F25B 21/02; H01L 35/00; H01L 35/28

(52) U.S. Cl. ..... 62/3.7; 62/3.2; 136/200; 136/203; 136/204

(58) Field of Search ..... 62/3.7, 3.2; 136/200, 136/203, 204

(56) References Cited

U.S. PATENT DOCUMENTS 3,899,359 A * 8/1975 Stachurski ..... 136/205
5,376,184 A * 12/1994 Aspden ..... 136/203
5,711,155 A * 1/1998 DeVilbiss et al. ..... 62/3.7
5,712,448 A * 1/1998 Vandersande et al. ..... 136/203
5,802,856 A * 9/1998 Schaper et al. ..... 62/3.7
6,346,668 B1 * 2/2002 McGrew ..... 136/200
6,494,048 B1 * 12/2002 Ghoshal et al. ..... 62/3.7

* cited by examiner

*Primary Examiner*—William C. Doerrler
*Assistant Examiner*—Filip Zec
(74) *Attorney, Agent, or Firm*—Dorsey & Whitney LLP

(57) ABSTRACT

Counter-current heat flow systems are disclosed, where heat containing medium flows in adjacent conduits arranged anti-parallel to one another so that the medium flowing from a warm zone to a cool zone flows adjacent to the medium flowing from the cool to the warm zone in the opposite direction. A plurality of heat pumps are distributed along the conduits to actively pump heat between adjacent points of the conduits. Little energy is required to pump heat between the adjacent points yet a large temperature difference can be maintained between the warm and the cool zones. The heat containing medium can be a fluid or an electric current. The medium in one conduit may have a different heat capacity than the medium in the other conduit. A controller may be included to regulate the plurality of heat pumps and/or the flow of the media to maintain a desired temperature at the warm zone or the cool zone.

26 Claims, 6 Drawing Sheets

COUNTER-FLOW HEAT PUMP

TECHNICAL FIELD

The invention relates to the field of counter-current flow cooling devices, more particularly to thermoelectric cooling devices.

BACKGROUND

Temperature is a crucial parameter in an enormous number of physical, chemical and biochemical processes and particularly in a variety of medical and electronic devices that can be operated more effectively at very cold temperatures. While thermoelectric coolers currently in use can readily reach and maintain temperatures in range of 300 K (room temperature) to 230 K, there is no solid-state cooler capable of reaching temperatures below 160 K.

Thermoelectric coolers, also known as Peltier coolers, have existed for many decades, but they have been unable to achieve temperatures cooler than about 210 K primarily because their efficiency drops in inverse proportion to the temperature difference across them. This fact is partly due to the temperature dependence of the properties of thermoelectric materials, but is also largely due to the traditional "brute force" structure of refrigeration devices including Peltier coolers FIG. 1 illustrates a standard Peltier cooler designed to reach low temperatures (~200 K). It consists of a cascade of zigzag structures of junctions between n-type and p-type semiconductors, sandwiched between ceramic plates. When a current flows through the structure, its top face absorbs heat from the environment and its bottom face releases heat to the environment. In other words, the device pumps heat from one face to the other.

Several conflicting processes are at work in this type of Peltier cooler. The current flow pumps heat as a result of the Peltier effect, but heat is generated by the $I^2R$ resistive heating. As heat is pumped, a temperature difference builds between the two faces of the device, so the Seebeck effect generates a voltage which opposes the current creating the temperature difference. Ordinary thermal conduction also allows some heat to flow back toward the cold side. The Thompson effects nearly cancel out in this device, so the Thompson effect is usually ignored.

The maximum temperature difference that can be developed by a standard single-stage Peltier cooler with no heat load is about 70 degrees Centigrade. Larger temperature differences, up to 140 degrees Centigrade, can be attained in multistage devices like that illustrated in FIG. 2. However, the pumping efficiency becomes very poor because each stage not only pumps heat that must be pumped in turn by the next stage, but each stage also generates resistive heat that must be pumped in turn by the next stage.

From a different art, in the design of ordinary fluid heat exchangers used in the heating industry it is standard practice to run fluid in opposite directions through two pipes in thermal contact as illustrated in FIG. 3. This works much better than moving the fluid in the same direction through the two pipes. A significant feature of fluid counter-flow heat exchangers is that the temperature difference between the two pipes is nearly zero everywhere along the exchanger, even though there can be a very strong temperature gradient along the length of the pipes.

Fluid counter-flow also occurs in the natural world where a continuous loop may form a fluid counter-flow exchange amplifier, which is essentially a counter-flow exchanger in which the fluid flows as illustrated in FIG. 3, but in which a component of the fluid is separated from the incoming flow and pumped across to the outgoing flow as indicated in FIG. 4. This occurs, for example, in the ocean, where nutrients are concentrated at the shoreline by a counter-flow process. The incoming fluid flows toward the shore along the bottom carrying nutrients, is warmed and flows away from the shore along the surface while gravity pulls the nutrients down to the incoming flow from the outgoing flow, trapping the nutrients in a loop. In another example, one mechanism by which living organisms maintain large ion concentration gradients in certain tissues such as the kidney, is by counter-flow amplification of the solute concentration in fluids flowing across semi-permeable membranes that connect kidney nephrons to blood vessels in counter-directional flow.

There is a need in the art to provide a thermoelectric cooler of a new design which can overcome the limitations of previous coolers and avoid some of the constraints that material properties impose on thermoelectric cooling. Further, there is a need to provide miniature thin film solid state coolers that are useful in computer applications.

SUMMARY OF THE INVENTION

The present disclosure fulfills these needs and others that will become apparent from the present description.

In one aspect there is provided a temperature control system, that includes :a counter-current heat exchanger having a first conduit that conveys a heat carrying medium along a forward path from a warm zone toward a cool zone, and a second conduit that conveys a heat carrying medium along a reverse path from the cool zone toward the warm zone, the reverse path being anti-parallel to the forward path. A plurality of heat pumps are distributed along the lengths of the first and the second conduits and are configured to pump heat from a first plurality of points along the forward path to an adjacent second plurality of points along the reverse path. A pump, such as a fan, a compressor or other device is attached to one of the conduits to urge a flow of fluid in at least one of the first and second conduits.

In certain embodiments, the heat carrying medium in at least one of the first and second conduits is a gas, a liquid, a vapor or an electric current. The heat carrying medium in the first conduit may be the same as in the second conduit, or may be a different substance, or the same substance in the same state. In various embodiments, the heat containing medium in one conduit has a different heat capacity than the heat containing medium in the other conduit. When the heat carrying medium is an electric current, the first conduit is a first conductor and the second conduit is made of a second conductor different from the first conductor. For example, one of the first or the second conductors may be p-type semiconductor and the other conductors may be an n-type semiconductor.

In certain embodiments the heat transfer system is configured to exchange a fluid between a first warm volume of fluid and a second cool volume of fluid. One example of this embodiment includes an air conditioning system that exchanges air between an indoor and outdoor volume while pumping heat between the air flowing in the first and the second conduits to maintain a selected temperature in the cool zone with efficient use of energy. More generally, in these embodiments the heat carrying medium in the first conduit is a fluid such as a gas, the first conduit has a first input port to receive an input of fluid from in the vicinity of the warm zone and an output port to convey the fluid to a second volume of fluid in the vicinity of the cool zone. The second conduit has a second input port to receive an input of fluid from the second fluid volume and a first output port to convey the fluid to the first volume of fluid. The plurality of heat pumps distributed between the first and second conduits pump heat from the internally directed warm air to the externally directed cooler air so, that the warm air is efficiently cooled by having its heat incrementally transferred by the counter flow arrangement.

In various embodiments, the heat pump is a Peltier junction, however in other embodiments, the heat pump may be any device that actively pumps heat from the first to the second conduit. Any of the foregoing embodiments may further include a controller that includes a sensor for detecting the temperature in the cool zone and which further outputs control signals to regulate the plurality of heat pumps responsively to the detected temperatures to maintain a desired temperature at one of the two zones. The controller may also be configured to receive a plurality of signals corresponding to the plurality of temperatures at the plurality of points along the first and the second conduits and also configured to regulate the plurality of heat pumps responsively to the plurality of temperatures. In typical embodiments, the controller also regulates a pump, such as fan that urges the flow of the fluid in at least one of the first conduit and the second conduits.

In another aspect, there is provided a Peltier cooling device that includes a first conductor configured to conduct a current flow in a forward direction from a warm zone to a cool zone, and a second conductor different from the first conductor and configured to conduct current in a reverse direction substantially anti-parallel to the forward direction from a cool zone to the warm zone. An electrically conductive junction between the first conductor and the second conductor is positioned at the cool zone (or the warm zone) and a thermally conductive, electrically insulating junction is positioned between the first and second conductors along a portion of their length. In this aspect, the heat is actively pumped across the thermally conductive junction while the current flows in one direction, and then reverses flow at the electrical junction to flow in the anti parallel direction.

A. DETAILED DESCRIPTION

The present disclosure may be better understood by reference to certain thermoelectric effects and mathematical representations of the same.

Figure 5:
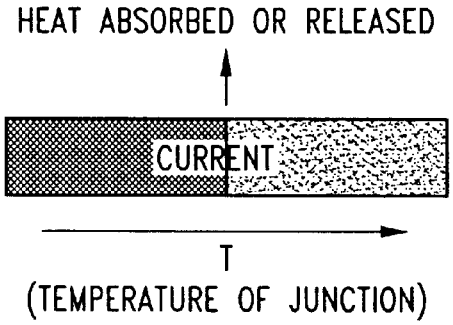
FIG. 5 graphically depicts the Peltier effect.
Figure 6:
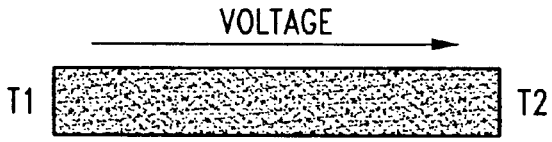
FIG. 6 graphically depicts the Seebeck effect.
Figure 7:
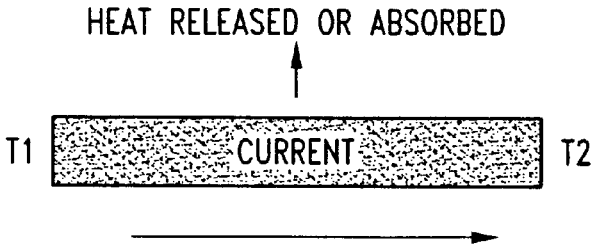
FIG. 7 graphically depicts the Thompson effect.

There are three closely related thermoelectric effects applicable to thermoelectric (Peltier) cooler design: the Seebeck effect, the Thompson effect, and the Peltier effect. In the Peltier effect, graphically depicted in FIG. 5, an electric current running through a junction between two dissimilar conductors either releases or absorbs heat depending on the direction of current flow and the nature of the charge carriers. In the Seebeck effect, graphically depicted in FIG. 6, a temperature difference between two junctions of dissimilar metals generates a voltage whose magnitude and direction depend on the temperature difference and the nature of the metals. In the Thompson effect, graphically depicted in FIG. 7, heat is released when current runs along a temperature gradient in a conductor, with a sign and magnitude depending on the nature of the charge carriers in the conductor, the Fermi levels, and the temperature gradient. All three of these effects are interrelated, and it is generally accepted that the Thompson and Peltier effects arise from the Seebeck effect.

The equations describing the thermoelectric effects are:

Seebeck Effect: $\Delta V_{13} = S(T_1 - T_2)$

Thompson Effect: $\Delta H_T = \sigma I(T_1 - T_2)$

Peltier Effect: $\Delta H_P = \alpha_{AB} I_P T$ where:

$T_1$ $\Delta H_T$ or $\Delta H_P$ equals the rate of heat released or absorbed

T equals the average temperature of the device $\sigma$ is the Thompson coefficient $\alpha_{AB}$ is the Peltier coefficient $K_p$ is the thermal conductance of the device $\Delta V$_is the Seebeck voltage generated by the temperature difference In a typical device, there is also always a Joule heating term and a thermal conduction term:

Joule Heating: $\Delta H_j = I^2 R$

Thermal Conduction: $\Delta H_ = K(T_1 - T_2)$ where R is the electrical resistance of the device, and I is the electrical current through the wire.

Figure 1:
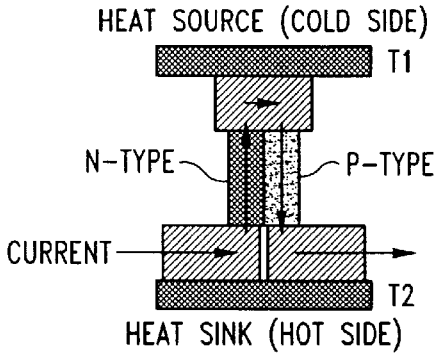
Fig. 1 (Prior Art)
FIG. 1 illustrates one embodiment of a standard Peltier Cooler according to the prior art.
Figure 2:
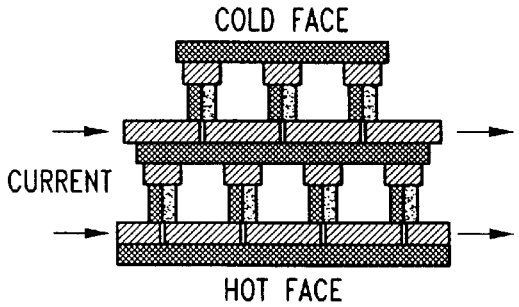
Fig. 2 (Prior Art)
FIG. 2 illustrates another embodiment of a standard Peltier cooler according to the prior art.
Figure 3:
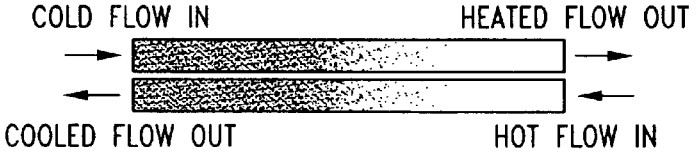
Fig. 3 (Prior Art)
FIG. 3 illustrates a fluid counter-flow heat exchanger according to the prior art.
Figure 4:
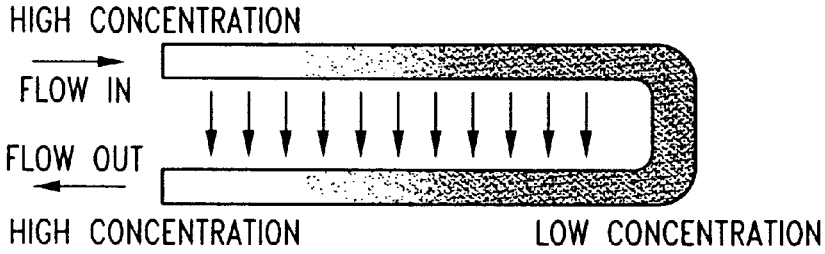
Fig. 4 (Prior Art)
FIG. 4 illustrates a fluid counter-flow amplifier according to the prior art.

A standard Peltier cooler, illustrated in FIG. 1, is normally described by the equation:

$$\Delta H = \alpha_{AB} IT + \tfrac{1}{2} I^2 R + K_p(T_1 - T_2)$$

assuming that half of the Joule heat flows in each direction.

In visualizing these effects at work, it is helpful to imagine that electrons (or holes) are a gas carried by wires which act like pipes. The electron gas carries heat just as an actual gas does, and it can be compressed just as an actual gas can be. In addition, though, the heat capacity of the electron gas depends on the nature of the material from which the wire is made. That is, a unit quantity of electrons in one kind of metal at a given temperature will carry a different amount of heat than the same quantity of electrons in a different kind of metal. The Thompson coefficient corresponds to the heat capacity of a charge carrier.

The Peltier effect results from the fact that the electron gas must release or gain heat to stay at a given temperature as it flows across a junction from one kind of metal to another kind of metal. The Seebeck effect results from the fact that the density of the electron gas is greater when its temperature is lower, so charge carriers will tend to concentrate at the cold end of a wire. The Thompson effect arises from the fact that an electron gas must gain heat in order for its temperature to be raised while it remains in a single material.

Figure 8:
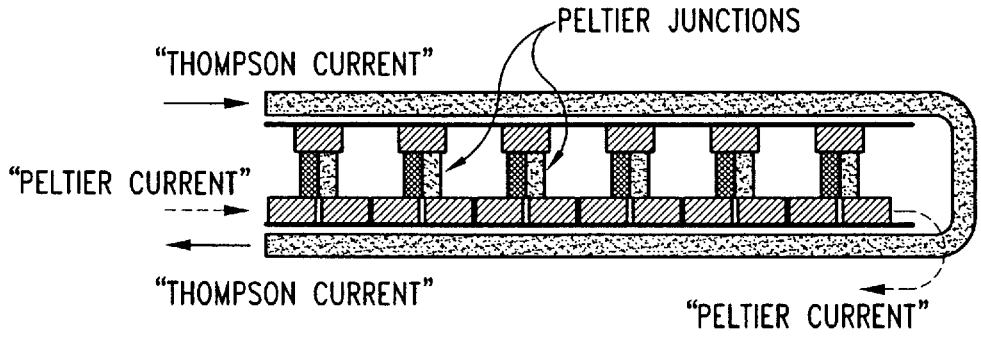
FIG. 8 illustrates one embodiment of a counter-current thermoelectric cooler according to the present invention.

FIG. 8 depicts one embodiment of a thermoelectric cooler that combines the aforementioned thermoelectric effects with the counter-current flow. The device includes counter-current exchange conductor, illustrated here as a bent path that reverses back on itself, where the Thompson current flow proceeds along the conductive path between a first conductive zone (upper zone) and a second conductive zone (lower zone). The current flows in substantially the opposite direction in the first conductive zone with respect to the second conductive zone. As used herein, substantially opposite direction means having a first current flow that is within a 90 degree angle of the direction exactly antiparallel to a second direction of current flow. FIG. 8 shows a plurality of Peltier junctions (as shown in more detail in FIG. 1) in thermoelectric contact between the first conductive zone and the second conductive zone of the counter-current exchange conductor. Although FIG. 8 shows a plurality of Peltier junctions, various embodiments of the invention are operable with as few as one Peltier junction. The Peltier junctions include a heat transfer material at the top (T1) and bottom (T2) and, a first conductive material (upper conductor) in thermoelectric contact with the upper heat transfer material, and the same (or similar) first conductive material in thermoelectric contact with the lower heat transfer material. The first conductive material is also in conductive contact with a second conductive material (e.g., N-type) which is different than the first conductive material for directing electron flow in one direction across the junction. It also includes a third conductive material (e.g., p-type) which is different from the second conductive material and which is in thermoelectric contact with the heat transfer material and in conductive contact with the first conductive material.

Figure 9:
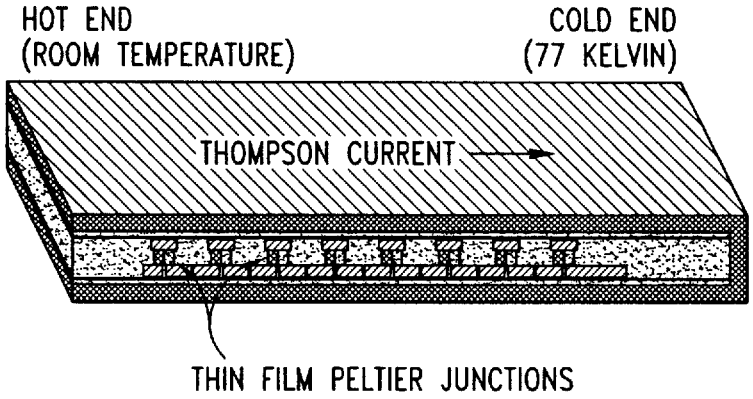
FIG. 9 illustrates predicted cooling performance of one embodiment of the counter-current thermoelectric cooler according the present invention.

As current flows from the first zone, a portion of the current crosses the upper heat transfer material (T1) and the first (upper) conductive material and passes down the p-type conductor to the first (lower) conductive material and through the lower heat transfer material to enter the lower zone of the counter-current flow. Exactly the opposite occurs for current flowing in the opposite direction. The result is that the current flow across each Peltier junction transfers heat from T1 to T2 (and in reverse). When the arrangement is incrementally repeated along successive Peltier junctions, the net result is a temperature gradient having a hot end near the entry point of the current flow and a cold end proximal to the bend between the zones of counter-current flow. FIG. 9 illustrates another embodiment wherein a similar structure is provided using thin film semiconductor material as part of the counter-current exchange path and/or the first and/or second conductive materials of the Peltier junctions. Such a device made of thin film materials provides a miniature thermoelectric cooler device suitable for use in a variety of electronic applications.

Any of the thermoelectric coolers provided herein may be referred to as "Counter-flow Exchange Peltier Cooler" (CEPC). CEPCs operate at high efficiency because the temperature difference that each junction pair operates across is very small. The CEPC is able to reach large temperature differences between its ends because the heat pumped from cooler regions will not flow through the Peltier junctions in warmer regions. Even though the strength of the Peltier effect is decreased as the temperature of the junction is reduced so the heat pumping rate per junction will be lower at the cold end of the device, the small temperature difference between the two faces of the device at each point along its length will maintain high thermoelectric efficiency. This allows the use of relatively small currents, thereby drastically reducing Joule heating which normally limits the achievable minimum temperature.

Another advantageous feature of the CEPC device is that, in contrast with standard Peltier coolers, the "hot" end of the device will only be slightly above room temperature. Whereas the heat pumped (and generated) by a standard Peltier cooler is exchanged with the air by a combination of thermal radiation and thermal conduction, both of which require high temperatures, the present counter-flow cooler exchanges heat with the electric current flowing through the "Thompson loop." The amount of heat transported out of the device depends on the product of the Thompson current and the exit temperature, so a large current allows a small exit temperature if the heat influx at the cool end is small Based on standard approximations, the equations which describe the performance of the new cooler depend on assigning discrete temperature nodes at the top and bottom of each Peltier device and can be represented as follows:

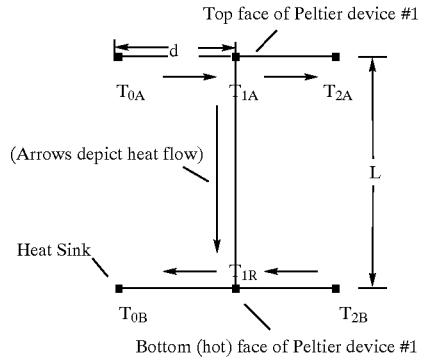

Taking the sum of the heat flows into the top face of the first Peltier device and setting to equal to zero (the equilibrium condition), the equation for node $T_{1A}$ is:

$$T_{1A}\left(\sigma I_{loop} + 2K_{loop}\frac{wa}{d} + \alpha_{AB} I_P - K_P\frac{w\delta}{L}\right) - \left(K_{loop}\frac{wa}{d}\right)T_{2A} - \left(\sigma I_{loop} + K_{loop}\frac{wa}{d}\right)T_{0A} + \left(\alpha_{AB} I_P - K_P\frac{w\delta}{L}\right)T_{1B} - \left(\frac{I_{loop}^2\rho_{loop}d}{aw} + I_P^2\frac{P_P L}{w\delta}\right) = 0$$

Likewise, the equation for $T_{1R}$ is found to be:

$$T_{1A}\left(aI_{loop} + K_P\frac{w\delta}{L}\right) - T_{1B}\left(K_P\frac{w\delta}{L} - \alpha I_{loop} - K_{loop}\frac{wa}{d} + K_{loop}\frac{wa}{d} - \sigma I_{loop}\right) + T_{2B}\left(\sigma I_{loop} + K_{loop}\frac{wa}{d}\right) + T_{0B}\left(K_{loop}\frac{wa}{d}\right) + \rho_P\frac{I_P^2 L}{w\delta} + \rho_{loop}\frac{I_{loop}^2 d}{aw} = 0$$

where d is the combined thickness of the legs of the Peltier device, α is the height of the Thompson loop, δ is the thickness of the Thompson loop, L is the length of the Peltier device legs, and w is the width of the Peltier device and Thompson loop, where the other parameters have been defined previously (the subscripts P and loop denote the parameters for the Peltier device and the Thompson loop, respectively).

Figure 10:
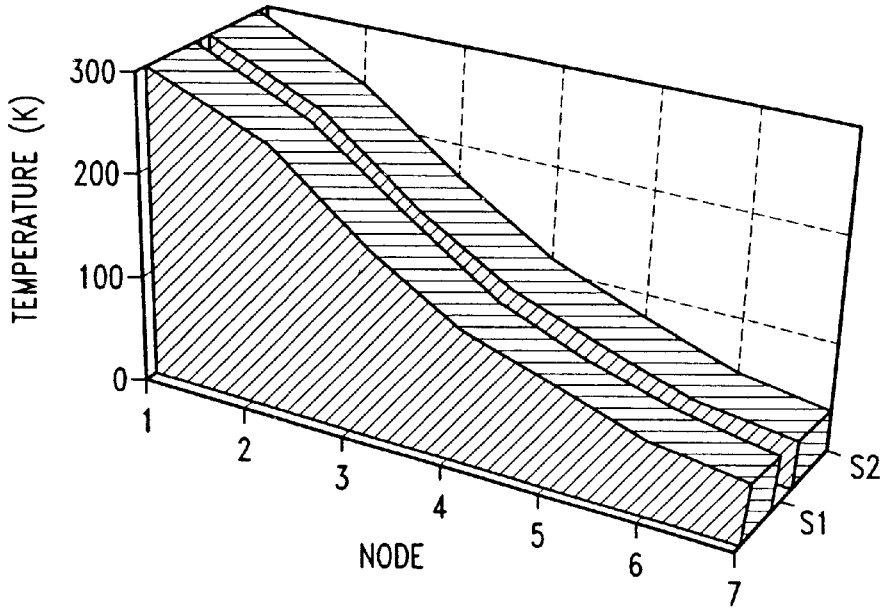
FIG. 10 illustrates a general embodiment of a counter-current heat control system having a plurality of heat pumps according to the present invention.

In some applications, these equations are not realistic at cryogenic temperatures. The Peltier and Thompson coefficients, as well as the resistivity and thermal conductivity, are all temperature-dependent. Also, standard approximations result in equations which permit negative absolute temperature—a clearly unrealistic situation. However, assuming reasonable room-temperature values of the coefficients and currents, a calculated performance of a CEPC cooler using only six junctions and obtained the results shown in the graph of FIG. 10. A typical device contains more junctions—on the order of 20 or more—because the thermoelectric performance of a junction declines by a factor of about 150 when operating temperature is reduced from 300 K to 85 K.

It is possible to construct a counter-flow exchange solid state cooler capable of maintaining a temperature of 100 to 77 degrees Kelvin under a heat load of 2 milliwatts, if the junction materials are carefully chosen for each node. It is known, for example, that "phonon drag" effects in certain semiconductors can lead to anomalously large Seebeck coefficients below 100 K, which improves thermoelectric performance. Junction materials that include $(Bi,Sb)_2(Te,Se)_3$ provide a $\Delta T$ of 3 degrees Celsius at 85 K. Also, the thermal conductivity can be dramatically reduced by forming the junctions from sintered powder and other microstructured materials.

Figure 11:
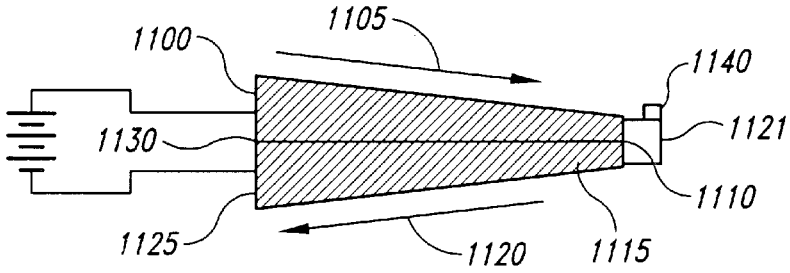
FIG. 11 illustrates an embodiment of a counter-current Peltier cooler according to the present invention.
Figure 12:
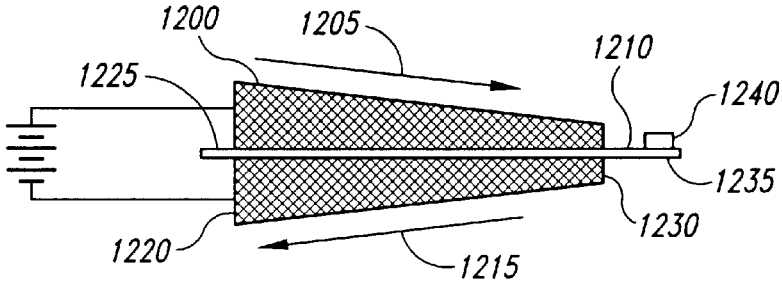
FIG. 12 illustrates another embodiment of a counter-current Peltier cooler according to the present invention.
Figure 13:
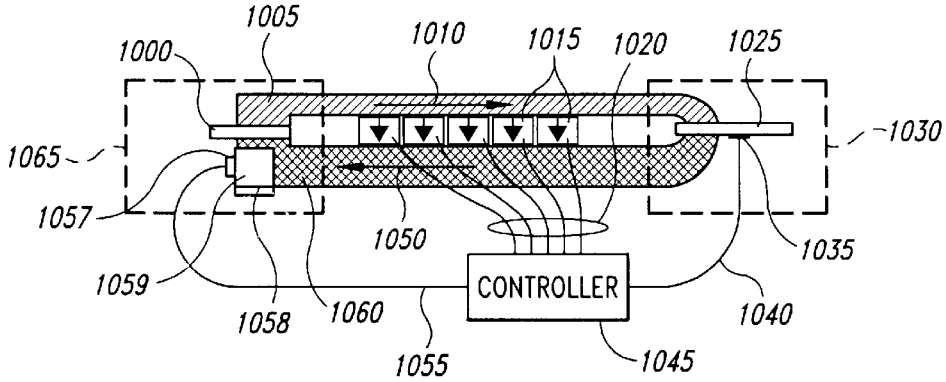
FIG. 13 illustrates a general embodiment of a counter-current heat control system with a plurality of heat pumps according to the present invention.

The counter-current flow of electric current is not only applicable to designs having a plurality of Peltier junctions distributed between two conductors, but is also applicable as a novel design for any Peltier cooler where the path of electrical current is a hairpin loop as shown in FIGS. 11, 12 and 13, and where heat exchange between the forward and reverse paths (e.g., 1205 and 1215) is encouraged by close proximity and a thermally conductive interface between the two paths along their length. FIG. 11 illustrates a Peltier junction in which the local current flow across the junction at points 1106. 1107 and 1108 is controlled by the thickness variation along its length and where the current flows in a substantially forward direction 1105 through one conductor (or semiconductor) 1100 from a warm end 1130 toward a cool end 1110 of the junction 1115 and in a substantially reverse, anti-parallel direction 1120 through a second conductor (or semiconductor) 1125 from the cool end 1110 of the junction 1115 toward the warm end 1130. The junction 1115 between the two conductors runs along the entire length of contact between the two conductors 1100 and 1125. As the current flows in the forward direction 1105 some current leaks across the junction 1115 at the plurality of points 1106, 1107 and 1108, causing incremental and continuous cooling along the junction 1115. A thermally conductive material 1121 is positioned in contact with the cool zone 1110 to conduct heat between the cool end 1121 and an object to be cooled 1140.

The wedged shape of the conductors 1100 and 1125 depicted in FIG. 11 illustrates one possible passive method for controlling the amount of current passing through each point along the junction. This system combines the heat pumping action across a counter-flow loop, with the bidirectional heat conveyance of a counter-flow loop. That is, electricity (carrying heat) flows toward the cool end and away from the cool end. As the electric current flows toward the cool end, heat is extracted from the current by the Peltier effect of the leakage current along the length of the junction at the plurality of points 1106, 1107 and 1108 between the conductors, effectively pumping the heat into the return current At the end of the junction (at the cool end), heat also may be extracted from an object such as a SQUID or IR detector.

FIG. 12 illustrates another embodiment of a Peltier junction with counter-current electric flow. As in FIG. 11, current flows from the warm end 1225 toward the cool end 1230 along a forward path 1205 and from the cool end 1230 toward the warm end 1225 along a reverse path 1215 that is effectively anti-parallel to the forward path. Again, the top conduit 1200 is a first type of conductor (or semiconductor) and the bottom conduit 1220 is a second type of conductor (or semiconductor). In this embodiment the only electrically conductive junction between the first conductor 1200 and the second conductor 1220 is positioned at the cool end 1230 of the junction. The two conductors are electrically insulated across a partial length of the conductors, but are in thermal contact along their lengths by a thermally conductive insulator 1207. The electrically conductive contact at the cool end 1230 includes a thermally and electrically conductive material 1210, which forms a cooling platform having a distal portion 1235 which is put in thermal contact with an object to be cooled 1240. Counterflow cooling along the length of the device ensures active cooling of the junction, setting up a temperature gradient from the warm end to the cold end and ensuring that the Peltier effect operates at maximum efficiency everywhere along the length.

Although the foregoing counter-current cooling systems have been described primarily in terms of thermoelectric effects and Peltier junctions, the principal of counter-current flow and active heat pumping between flows along their lengths can be implemented with any type of counter-current flow of heat carrying media and with any type of heat pump. For example, with respect to heat pumps, instead of Peltier junction pumps to actively pump heat from one side of the counter-flow exchange loop to the other, it is possible to use evaporative heat pumps or small refrigerators employing standard cycles of compression and expansion to pump heat. Other physical processes that may be employed for heat pumping in the context of this invention include, but are not limited to thermomagnetism, absorption/desorption, and thermionic emission.

With respect to the heat carrying medium, although the counter-flow loop has been described herein primarily as an electrical conductor employing the Thompson effect, other embodiments of a counter-flow heat exchanger can make use of any type of heat-carrying medium. For example, instead of conveying heat in the form of moving electrical charge carriers (electrons and holes) in conductors or semiconductors, it is possible to convey heat in the flow of gases, vapors or liquids through pipes or other types of conduits. Moreover, if the hot-to-cold flow is a substance in the liquid phase and the cold-to-hot flow is the same substance in the gas phase, the two flows have different heat capacities even though the same mass is flowing in each conduit. As a result, if the two flows are at the same temperature at corresponding points along the two conduits, more heat will be flowing in one conduit than the other, with the net result that heat is removed from the cold end and conveyed to the hot end. When heat is actively pumped from one conduit to the other along the lengths of the conduits, heat pumping can be done at maximum efficiency and a large temperature gradient can be maintained between the hot and cold ends of the paired conduits. This same principle is in operation with the electrical embodiments described above, where the two conduits are semiconductors or conductors carrying electrical current with different heat capacities because electrons flowing in a circuit through the loop carry more heat in the cold-to-hot direction than in the hot-to-cold direction. Thus, the general principal exemplified by an electrical medium is applicable to any heat carrying medium.

Accordingly, another aspect of the heat control system includes a counter-flow loop in which the medium in the hot-to-cold side of the loop has a lower heat capacity than the medium in the cold-to-hot side of the loop. For example, one side of the loop can be made of n-type semiconductive material and the other side of the loop can be made of p-type semiconductive material, or one side can be made of a first kind of metal and the other side can be made of a second kind of metal, or one side can be a substance in the liquid phase while the other side carries the same substance in a gas or vapor phase. The advantage to this arrangement is that the cold-to-hot side of the loop carries more heat than the hot-to-cold side of the loop, while nonetheless maintaining a very small temperature difference across adjacent points between the two sides of the loop. In the steady state, the heat pumps are operating across a very small temperature difference and thus are operating at optimal efficiency.

FIG. 13 illustrates a general embodiment of a temperature control system using counter-current flow of a heat carrying medium that is applicable to any heat carrying medium and any type of heat pump. The system includes a first conduit 1005 that conveys a forward flow 1010 of heat in a heat carrying medium from a warm zone 1065 toward a cool zone 1030 and a second conduit 1060 that conveys a reverse , anti-parallel flow 1050 of heat in the heat carrying medium from a cool zone 1030 toward the warm zone 1065. The first conduit 1005 and the second conduit 1060 are thermally coupled by a plurality of active heat pumps 1015 arranged between the conduits 1005 and 1060 to pump heat between the flow paths. An object to be cooled 1025 is positioned at the cool zone 1030 and a heat sink 1000 is positioned at the warm zone 1065, both in thermally conductive contact with the conduits 1005 and 1060.

The system includes a controller 1045 to regulate the overall heat flow so as to maintain a desired temperature at either the warm zone 1065 or the cool zone 1030. In a cooler design, the controller 1045 is configured to maintain a selected temperature at the cool zone, however, the system can also be configured in reverse to regulate temperature at the warm zone. The controller 1045 includes a temperature sensor 1040 to detect the temperature of the object to be cooled 1025 or the temperature of the cool zone 1030, a plurality of heat pump regulators 1050 that include sensors to detect the temperature at a plurality of locations along the forward conduit 1005 and the reverse conduit 1060, as well as heat pump control elements to regulate the operation of each of the plurality of heat pumps 1015. The controller 1045 is also operably connected to flow control elements 1055 and includes a sensor 1057 to detect the temperature in the warm zone (and/or the cool zone) and a regulator 1058 to control a fluid flow device 1059 that urges the flow of the heat carrying medium in at least one of the forward flow conduit 1005 and the reverse conduit 1060.

The type of flow control elements 1055 and regulators 1058 and fluid flow devices 1059 depends on the type of heat carrying medium being used in the conduits. For example the flow device 1059 may be a fan, compressor, or pump when the heat carrying medium is a fluid and the regulator 1058 controls the rate of the device to regulate the flow of fluid. When the conduits are carrying an electric current, the regulator 1058 may be rheostat or other electrical device that regulates the current, voltage or resistance of the current flow through the conduits. Thus, in certain embodiments, the flow control element 1055 and regulator 1058 can be an integral device. The controller 1045 includes a processor (not shown) that is programmed to regulate the activity of each of the plurality of heat pumps 1015 and the flow control elements 1055 in response to the detected temperature of the object to be cooled 1025 and/or the cool zone 1030, and/or the temperatures at the plurality of locations in the conduits 1005, 1060 and on the temperature in the warm zone 1065 detected by sensor 1057. Because heat is being actively pumped at several locations along the path of the counter-current flow, the temperature difference across the conduits 1005 and 1060 at each one of the plurality of heat pumps 1015 will be small in comparison to the temperature difference between the warm zone 1065 and the cool zone 1030. Therefore, relatively little input of energy is required for each heat pump to transfer heat at each location along the conduit. At the same time, the sum of the differences in temperatures between the pumps will be relatively large, thereby maintaining a large temperature difference between the warm zone 1065 and the cool zone 1030.

The heat carrying medium in the forward flow 1010 and reverse flow 1050 may be any medium for conveying heat, including but not limited to, a gas, a liquid, a vapor, thermally conductive solid, an electric current or combinations of the same. In typical embodiments, the heat carrying medium in the forward flow 1010 is the same substance as the heat carrying medium in the reverse direction 1050. In other embodiments, the heat carrying medium in the forward flow 1010 is a different substance than the heat carrying medium in the reverse flow 1050. In still other embodiments, the heat carrying medium in the forward flow 1010 is the same substance as the heat carrying medium in the reverse flow 1050, but in a different physical state. For example, the forward flow 1010 heat carrying medium 1010 may be a liquid while the reverse flow 1050 may be a gas, or vice versa. Using different substances (or different states of the same substances) for the heat carrying medium in the forward flow 1010 relative to the heat carrying medium in the reverse flow 1050 provides for a difference in heat capacity (i.e., a different specific heat) for the medium in the first conduit 1005 relative to the medium in second conduit 1060.

As mentioned above, in certain embodiments, the heat carrying medium in the forward direction 1010 is a substance in the liquid state and the heat carrying medium in the reverse direction 1050 is the same substance in a vapor or gaseous state. To carry the same mass of the same substance in different states will require that the first conduit 1005 be smaller than the second conduit 1060. Thus, FIG. 13, illustrates an embodiment where the first conduit 1005 carrying the forward heat carrying medium 1010 is wider than the second conduit 1060 carrying the reverse flow of the heat carrying medium 1050. One of ordinary skill in the art will appreciate that the relative dimensions of the first conduit 1005 and the second conduit 1060 are not drawn to scale but are drawn merely to illustrate different dimensions for the conduits. The same person of ordinary skill will recognize that the particular dimensions will vary with particular designs, with particular purposes and with particular types of media. The relative dimensions of the first conduit 1005 and the second conduit 1060 may be selected, for example, to accommodate the same mass of the heat carrying media 1010, 1050 in the liquid state and in the gas or vapor state as mentioned above. In such cases, the first conduit 1005 carrying a liquid would have a small cross sectional area while the second conduit 1060 carrying a gas would have wide cross sectional area, such as in a rectangular duct. For the same mass of the same substance, the specific heat is ordinarily greater for the substance in the gas or vapor state than in the liquid state, therefore, at the same temperature, more heat is carried by the reverse flow 1050 than the forward flow 1010 of heat carrying medium. Thus, more heat is carried from the object to be cooled 1025 and deposited in heat sink 1000 by reverse flow 1050 than is carried to the object 1025 by forward flow 1010. Although FIG. 13 depicts an embodiment with conduits of different dimensions, this feature is not necessary for operation of the invention in other embodiments.

Providing the counter-flow heat exchanger with forward 1010 and reverse 1050 flow conduits of different sizes is also useful when the heat carrying medium in the first conduit 1005 is gas that is accelerated through an insulated expansion valve, sometimes referred to as Joule Thompson valve (not shown in FIG. 13). Rapid expansion by accelerating a gas through a Joule-Thompson valve results in lowering of the temperature of the heat carrying medium in the vicinity of the valve. Thus, placing the Joule-Thompson valve at the junction between the first conduit 1005 and the second conduit 1060 at the cool end 1030 of the heat transfer system in conjunction with the thermal contact between the junction and the object to be cooled 1025, further facilitates cooling of the object 1025. When the heat carrying medium is to be conveyed as a flow through such a Joule-Thompson valve, a pump, fan, compressor or other suitable device for accelerating the gas is provided to supply the necessary motive force (not shown in FIG. 13).

Various embodiments of a temperature control system with counter-current heat exchanges have applications beyond micro-cooling. For example, the controller 1045 configured with the temperature control system of counter-current flow depicted in FIG. 13 can be used to regulate the temperature in a confined volume (i.e., the cool zone). The confined volume can be a residence, a refrigerator or freezer, an oven, a biochemical reactor, or anything else that needs to be maintained at a constant temperature or needs heat removed from it at a particular rate.

Figure 14:
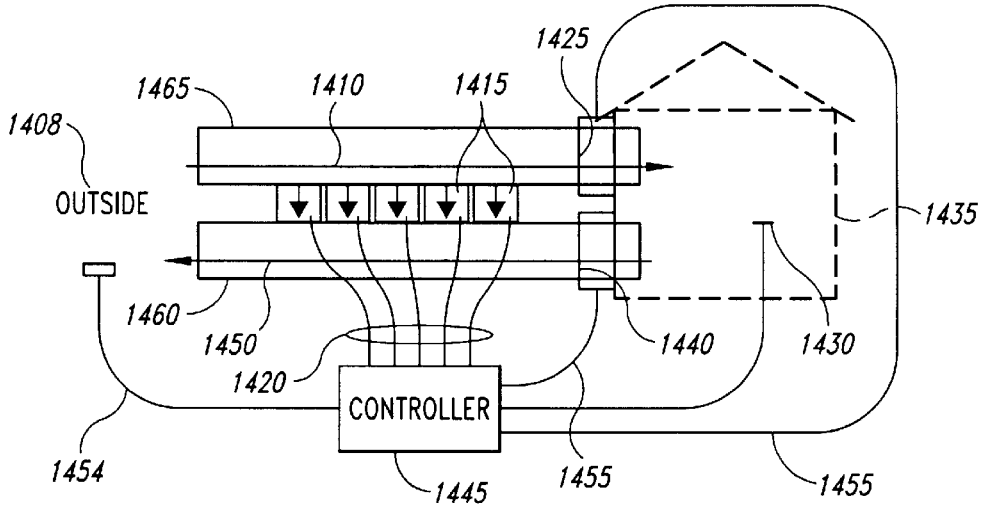
FIG. 14 illustrates a residential air conditioning system using a counter-current heat control system with a plurality of heat pumps according to the present invention.

FIG. 14 illustrates an embodiment of a residential air conditioning system that uses the temperature control system disclosed herein to exchange indoor air with outdoor air while efficiently controlling the gain or loss of heat and maintaining a desired temperature at the inside of a residence. Fresh air from the warm outside 1408 is drawn by fan 1425 into the first conduit 1465 forming a forward air flow 1410 which is forced to the inside 1435 of the residence. The air on the inside 1435 is drawn by counter-flow fan 1440 toward the warm outside 1408 forming the reverse, anti-parallel air flow 1450 within the reverse conduit 1460. A plurality of heat pumps 1415 is thermally coupled between the forward conduit 1465 and the reverse conduit 1460 to actively pump heat from one flow to the other to remove heat from the flow that is initially warmer and transfer it to the flow that is initially cooler. The heat pumps may be any suitable heat pumping apparatus, including but not limited to Peltier devices, standard vapor evaporation/condensation refrigerator elements and the like.

Heat controller 1445 includes a temperature sensor 1430 located at the cooler inside of the residence 1435 and another temperature sensor 1454 located at the warmer outside. Heat controller 1445 also includes a plurality of heat pump regulators 1420 that optionally detect the temperature at a plurality of positions in the forward 1465 and reverse 1460 conduits and regulate the activity of the plurality of heat pumps 1415. The controller 1445 may optionally further include fan control elements 1455 that control the rate of the forward air flow 1410 and the reverse air flow 1450. By adjusting the rate of heat pumping across the plurality of heat pumps 1415 and the rate of air flow in the forward 1410 and reverse 1450 directions in response to the temperature detected by sensor 1430, the temperature of the indoor air 1435 may be adjusted higher or lower until a desired temperature is reached. Coordinated control of the fans 1425, 1455 and heat pumps 1415 relative to the detected temperatures in the inside 1435 and outside 1410 is accomplished by use of a microprocessor (not shown).

From the foregoing it will be appreciated that, although specific embodiments of the invention have been described herein for purposes of illustration, various modifications may be made without deviating from the spirit and scope of the invention. Accordingly, the invention is not limited except as by the following claims.

Bibliography. The following references may further aid in understanding or implementation of various aspects of the present invention and are hereby incorporated by reference:

1. *Frigichip Thermoelectric Cooling Devices* Melcor Engineering Catalog 1994.
2. Atramet, Inc. thermoelectric coolers catalog, 1994.
3. Atramet, Inc., private communication September, 1994.
4. H. J. Goldsmid, *Thermoelectric Refrigeration* Plenum Press 1964.
5. H. J. Goldsmid, *Electronic Refrigeration* Pion Limited 1986.
6. *Thermoelectric Materials* ed. Marshall Sittig, Noyes Data Corporation 1970.
7. E. Behnen, "Quantitative examination of the thermoelectric power of n-type SI in the phonon drag regime," *J. Appl. Phys* 67(1), Jan. 1, 1990.
8. A. A. Joraide, "The effect of anisotropy on the electrical properties of compacted semiconductor $(Bi_2Te_3)_{25}$—$SB_2TE_3)_{75}$ powders", *J. Appl. Phys.* 73 (11), Jun. 1, 1993.
9. J. Vandersande, J-P Fleurial, J. Beaty and J. Rolfe, "Phonon-Scattering Centers Increase Thermoelectric Efficiency," NASA Tech Briefs, August 1994.
10. J. Jinenez, E. Rojas, and M. Zamora, "Device for simultaneous measurement of the Peltier and Seebeck coefficients: Verification of the Kelvin relation," *J. Appl. Phys.* 56(11), Dec. 1, 1984.

What is claimed is:

1. A temperature control system, comprising:

a counter-current heat exchanger having a first conduit that conveys a heat carrying medium along a forward path from a warm zone toward a cool zone, and a second conduit that conveys a heat carrying medium along a reverse path from the cool zone toward the warm zone, the reverse path being anti-parallel to the forward path; and a plurality of heat pumps distributed along the lengths of the first and the second conduits and configured to pump heat from a first plurality of points along the forward path to an adjacent second plurality of points along the reverse path.

2. The temperature control system of claim 1 further comprising a pump to urge a flow of fluid in at least one of the first and second conduits.

3. The temperature control system of claim 1 wherein the heat carrying medium in at least one of the first and second conduits is a gas.

4. The temperature control system of claim 1 wherein the heat carrying medium in at least one of the first and second conduits is a liquid.

5. The temperature control system of claim 1 wherein the heat carrying medium in at least one of first and second conduits is a vapor.

6. The temperature control system of claim 1 wherein the heat carrying medium in one of first or second conduits is a substance in a liquid state and the heat carrying medium in the other of the first or the second conduits is the same substance in at least one of a gas or a vapor state.

7. The temperature control system of claim 1 wherein the heat carrying medium is a an electric current and the first conduit and the second conduit comprise a conductor of the electric current.

8. The temperature control system of claim 7 wherein the first conduit comprises a first conductor and the second conduit comprises a second conductor different from the first conductor.

9. The temperature control system of claim 8 wherein one of the first or the second conductor is a p-type semiconductor and the other of the first or second conductors is a n-type semiconductor.

10. The temperature control system of claim 1 wherein the specific heat of the heat carrying medium differs between the first and second conduits.

11. The temperature control system of claim 1 wherein the heat pump comprises a Peltier junction.

12. The temperature control system of claim 1 wherein the medium in the fist conduit is a different substance from the medium in the second conduit.

13. The temperature control system of claim 1 wherein the heat carrying medium is a fluid and wherein the first conduit is coupled to the second conduit at one of the warm zone or the cool zone to form a half closed conduit path.

14. The temperature control system of claim 1 wherein the heat carrying medium is a fluid, and wherein the first conduit is coupled to the second conduit at the warm zone and the cool zone to form a closed conduit path.

15. The temperature control system of claim 1 wherein the heat carrying medium is a fluid, wherein the first conduit has a first input port to receive an input of fluid from a first fluid volume in the vicinity of the warm zone and a first output port to convey the fluid to a second volume of fluid in the vicinity of the cool zone, wherein the second conduit has a second input port to receive an input of fluid from the second fluid volume and a first output port to convey the fluid to the first volume of fluid, so that the heat carrying medium is exchanged between the first volume of fluid and the second volume of fluid.

16. The temperature control system of claim 12 configured as an air conditioning system, wherein the fluids pumped in the forward and reverse fluid flow conduits are outdoor and indoor air, respectively, so that the indoor air is exchanged with outdoor air and heat is actively exchanged between the indoor air and the outdoor air by the plurality of heat pumps to maintain a desired indoor temperature.

17. The temperature control system of claim 1 further comprising a controller that receives a first signal corresponding to a first temperature in the cool zone and a second signal corresponding to a second temperature in the warm zone and which outputs a plurality of control signals to regulate the plurality of heat pumps responsively to the first and second signals to maintain a desired temperature at one of the two zones.

18. The temperature control system of claim 17 wherein the controller receives a plurality of signals corresponding to a plurality of temperatures at a plurality of points along the first and the second conduits and regulates the plurality of heat pumps responsively to the plurality of temperatures.

19. The temperature control system of claim 17 wherein the heat carrying medium is a fluid and the controller further regulates a pump that urges the flow of the fluid in at least one of the first conduit and the second conduits.

20. A heat transport system, comprising:

a counter-current heat exchanger having a first conduit that conveys a heat carrying medium having a first specific heat, along a forward path from a starting zone to an ending zone, and a second conduit that conveys a heat carrying medium having a second specific heat along a reverse path from the end zone toward the starting zone, the reverse path being anti-parallel to the forward path, the first specific heat being different from the second specific heat;

a plurality of heat pumps distributed along the lengths of the first and second conduits and configured to pump heat between a first plurality of points along the forward path and an adjacent second plurality of points along the reverse path;

a first thermally conductive connection that transfers heat from an object to the heat-carrying medium in the vicinity of one of the starting zone and the ending zone, and a second thermally conductive connection that transfers heat from the thermally conductive medium to a heat sink in the vicinity of the other of the starting zone or the ending zone.

21. The temperature control system of claim 20 further comprising a controller that receives a first signal corresponding to a first temperature in the starting zone and a second signal corresponding to a second temperature in the ending zone and which outputs a plurality of control signals to regulate the plurality of heat pumps responsively to the first and second signals to maintain a desired temperature difference between the starting zone and the ending zone.

22. The temperature control system of claim 21 wherein the controller receives a plurality of signals corresponding to a plurality of temperatures at a plurality of points along the first and the second conduits and regulates the plurality of heat pumps responsively to the plurality of temperatures.

23. The temperature control system of claim 20 wherein the heat carrying medium is a fluid and the controller further regulates a pump that urges the flow of the fluid in at least one of the first conduit and the second conduits.

24. A temperature control system, comprising a forward-flow fluid conduit having first-input port configured to receive fluid from an open external volume and a first output-port configured to convey fluid to a confined interior volume;

a reverse-flow fluid conduit configured to receive fluid from the confined interior volume and a second output port to convey fluid to the open exterior volume, the reverse flow fluid conduit being arranged anti-parallel and adjacent to the forward-flow fluid conduit;

a plurality of heat pumps coupling the forward flow fluid conduit to the reverse flow fluid conduit and distributed to pump heat between a first plurality of points along the length of the forward conduit and a second plurality of points along an adjacent length of the reverse flow conduit;

a first fluid pump configured to urge fluid flow from the first input port toward the first output port;

a second fluid pump to configured to urge a fluid flow from the second input port toward the second output port;

a detector to provide a signal indicating the temperature of the confined volume of fluid, and a controller that receives the signal, and which is operatively connected to the plurality of heat pumps and to at least one of the first and second fluid pumps to regulate the rate of fluid flow and the rate of heat pumping responsively to the signals.

25. The temperature control system of claim 24 wherein the controller receives a plurality of signals corresponding to a plurality of temperatures at the plurality of points along the first and the second conduits and regulates the plurality of heat pumps responsively to the plurality of temperatures.

26. A Peltier cooling device comprising a first conductor configured to conduct a current flow in a forward direction from a warm zone to a cool zone;

a second conductor different from the first conductor and configured to conduct current in a reverse direction substantially anti-parallel to the forward direction from a cool zone to the warm zone; and an electrically conductive junction between the first conductor and the second conductor, the conductive junction being positioned at least at the cool zone; and a thermally conductive, electrically insulating junction between the first and second conductors along a portion of their length.

* * * * *